United States Patent [19]

Caron

[11] 4,133,329

[45] Jan. 9, 1979

[54] ELECTRONIC IGNITION DEVICE FOR INTERNAL COMBUSTION ENGINES

[76] Inventor: Charles Caron, 64, avenue du Lignon, Geneva, Switzerland CH-1219

[21] Appl. No.: 707,102

[22] Filed: Jul. 20, 1976

[30] Foreign Application Priority Data

Jul. 29, 1975 [CH] Switzerland ..... 9842/75

[51] Int. Cl.[2] ..... F02P 3/06

[52] U.S. Cl. ..... 123/148 CB; 315/209 CD

[58] Field of Search ..... 123/148CB; 315/209SCR, 315/209 CD

[56] References Cited

U.S. PATENT DOCUMENTS

| | | | |
|---|---|---|---|
| 3,714,507 | 1/1973 | Schweitler et al. | 315/209 CD |
| 3,898,971 | 8/1975 | Lefeure | 123/148 CB |

*Primary Examiner*—Samuel Feinberg
*Attorney, Agent, or Firm*—Emory L. Groff, Jr.

[57] ABSTRACT

An electronic ignition device for an internal combustion engine comprises a capacitor supplied by a charging circuit, a thyristor controlling discharge of the capacitor into the primary of an ignition coil, and a control circuit including an oscillator successively producing non-conduction and conduction of the thyristor several times in response to each opening of a contact-breaker. The device also comprises an RC delay element and a bistable trigger controlled to prevent operation of the control circuit when the device is switched on while the contact-breaker is in a given position, said trigger permitting operation of the control circuit as soon as the contact-breaker comes into action.

2 Claims, 1 Drawing Figure

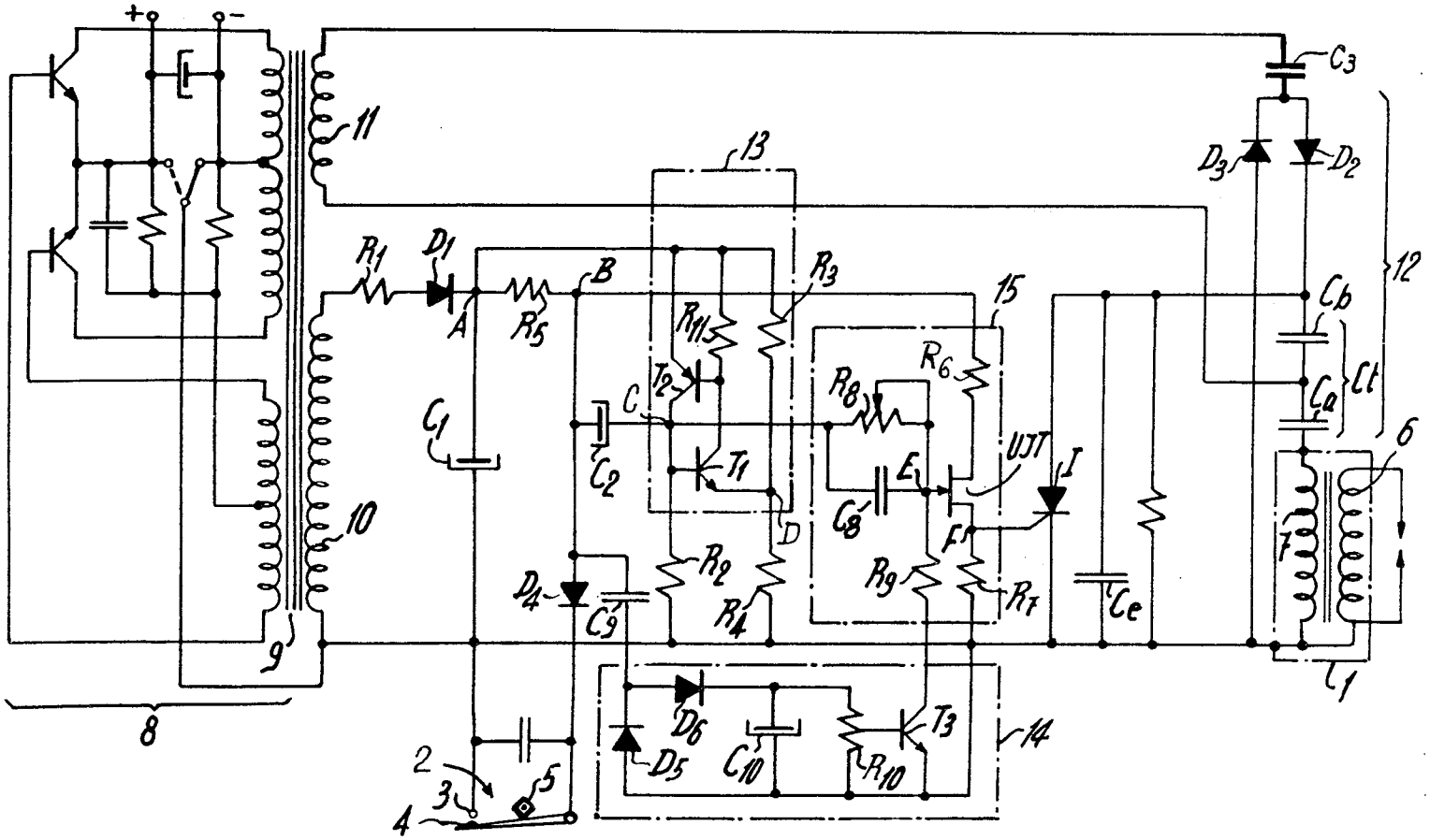
12
6
C3
D2
D3
Cb
Ca
Ct
L1
T
Ce
I
UJT
R7
15
14
R6
E
F
T3
R9
R10
R8
C8
R3
D
13
T1
R4
R11
T2
R2
C10
D6
D5
C
C2
C9
B
D4
R5
5
A
C1
D1
2
3
4
R1
11
10
9
8
+
-

ELECTRONIC IGNITION DEVICE FOR INTERNAL COMBUSTION ENGINES

The invention relates to electronic ignition devices for internal combustion engines.

A known type of electronic ignition device for internal combustion engines comprises a tripping device such as a contact-breaker, an ignition coil, a capacitor connected to a charging circuit, and an electronic switch controlling the discharge of this capacitor into the ignition coil, the switch being controlled from the tripping device by a control circuit.

In these devices it is known to provide a circuit for controlling the electronic switch to successively open and close it several times for each control of the tripping device to hence provide a succession of sparks which favourizes starting of the engine when cold, and running at low speeds.

During starting of the engine, if the circuit breaker is in its open position, it is undesirable that a spark should be produced, since this could detonate a mixture remaining in a cylinder in which the compression has not yet passed, which tends to start the engine in the wrong direction of rotation.

An aim of the invention is to avoid this drawback.

According to the invention a device of the above type is characterized in that it comprises delay means for preventing operation of the control circuit of the electronic switch during its switching on when the tripping device is in a given position, said delay means permitting operation of the control circuit as soon as the tripping device enters into action by moving to another position.

The single FIGURE of the accompanying drawing shows, by way of example, a schematic circuit diagram of an embodiment of the device according to the invention.

The illustrated device is intended to be fitted to an internal combustion engine with a conventional ignition coil 1 and a contact-breaker 2 having a fixed contact 3 and a mobile contact 4 actuated by a cam 5.

The ignition coil 1 is formed of a transformer comprising a high-voltage secondary winding 6 and a primary winding 7 which receives, via a thyristor I, the discharge current of a capacitance $C_t$ formed of two capacitors $C_a$ and $C_b$.

The device comprises two voltage sources one of which serves to charge the capacitance $C_t$ to a relatively high voltage and the other to supply the control circuit at a lower voltage. An oscillator 8 of known type, supplied by a storage battery, applies an alternating component to a transformer 9 whose secondary windings 10 and 11 form the two sources of different alternating voltages.

The charging circuit of capacitance $C_t$ comprises a capacitor $C_3$ to avoid the oscillator being short-circuited during ignition and a voltage doubler 12. When the thyristor I is non-conducting, the capacitance $C_t$ is charged to double the voltage supplied by the secondary winding 11, the charging current passing by the primary winding 7 of the ignition coil and by two diodes $D_2$ or $D_3$. When the thyristor I is made conducting, the capacitance $C_t$ is connected to the terminals of the primary winding 7 and discharges therein, inducing a high voltage in the secondary winding 6. To quench overvoltages liable to make the thyristor I conduct, a capacitor $C_e$ is connected between the anode and the cathode of this thyristor.

The control circuit of thyristor I is supplied by the voltage source formed by winding 10 and comprises a bistable trigger 13, an integrator circuit 14 and a relaxation oscillator 15.

The supply of the bistable trigger 13 is taken at a point A whose voltage is equal to the charging voltage of a capacitor $C_1$ which is charged by winding 10 via a resistor $R_1$ and a diode $D_1$. The supply of oscillator 15 is obtained from a point B which is connected to point A by a resistor $R_5$ and is also connected, via a diode $D_4$, to the mobile contact 4 of circuit breaker 2.

The bistable trigger 13 comprises two transistors $T_1$ and $T_2$ interconnected in such a manner that this trigger adopts one or the other of its states according to whether a capacitor $C_2$, connected to point B, transmits a positive or a negative pulse to a point C. In effect, when a positive peak is applied to point C by capacitor $C_2$, the transistor $T_1$ becomes conducting, since the voltage of this peak is greater than the voltage obtained at point D which is the output of a divider connected between point A and ground, this divider being formed by two resistors $R_3$ and $R_4$. As soon as transistor $T_1$ conducts, the potential of its collector, which is connected to the base of transistor $T_2$, becomes practically equal to the potential at point D. The transistor $T_2$ thus becomes conducting and transmits, by its emitter-collector circuit, the potential of point A to point C. This potential acts on the base of transistor $T_1$ and holds it conducting.

The two transistors $T_1$ and $T_2$ thus remain conducting until the moment when a negative pulse is applied through the capacitor $C_2$ to the base of transistor $T_1$. This negative pulse makes the transistor $T_1$ non-conducting, so that the base of transistor $T_2$ takes the same potential as the emitter of transistor $T_2$, and the latter thus becomes non-conducting.

When the engine is running, the circuit-breaker 2 opens and closes continuously, so that the potential at the lead-in of capacitor $C_2$ varies according to a square wave. Transistors $T_1$ and $T_2$ thus together become conducting, then non-conducting at the rhythm of opening and closing of the contacts 3 and 4 of circuit-breaker 2.

When the point C is positive in relation to ground, the oscillator 15 operates and each time the potential of point E (i.e. the potential of the emitter of an unijuntion transistor UJT) becomes greater than the conduction threshold of transistor UJT, the latter becomes conducting. This conduction threshold is determined by two resistors $R_6$ and $R_7$ connected to the two bases of transistor UJT. At the moment when the latter becomes conducting, capacitor $C_8$, which connects points C and E, charges via transistor UJT and produces a voltage drop across a resistor $R_7$. The voltage at the terminals of this resistor forms the control voltage of thyristor I.

At the moment of conduction of transistor UJT, the charge stored by capacitor $C_8$ dissipates into an adjustable-resistance resistor $R_8$. The potential of point E, which has dropped practically to ground potential, progressively rises during the discharge of capacitor $C_8$ and when it once more reaches the conduction potential of transistor UJT it brings about a new discharge. The capacitance of capacitor $C_8$ and the resistance of resistor $R_8$ are determined so that a conduction of the transistor UJT is obtained about every three milliseconds. Hence the thyristor I is also made conducting every 3 ms and each time gives rise to a discharge of capacitance $C_t$ into the ignition coil 1. One hence obtains, for each ignition period in a cylinder of the engine, a succession of ignition sparks, which ensures excellent ignition, even in the worst conditions, such as extreme cold, fouled spark plugs, a too-great spacing of the spark plug electrodes, and so on.

The integrator 14 limits ignition to a single discharge per ignition time as soon as the speed of the engine reaches a certain value. In effect, as soon as the engine reaches a sufficient speed, the second spark, which is produced 3 ms after the first, has no useful purpose. At a speed of 1800 r.p.m., i.e. 30 revolutions per second, a duration of 3 ms corresponds to 0.09 of a complete rotation, i.e. an angle of 32.5°. It is thus advantageous to suppress all discharges after the first, since in multicylinder engines a redundant discharge could be produced in a cylinder in the explosion stroke and prevent a complete re-charging of the capacitance $C_t$ from being obtained at the moment when an ignition discharge should be supplied to another cylinder.

The integrator 14 comprises a capacitor $C_{10}$ connected in parallel with a sliding-contact resistor $R_{10}$. Capacitor $C_{10}$ is charged by the positive voltage pulses delivered by a capacitor $C_9$ connected to point B, which positive pulses pass through a diode $D_6$, whereas negative pulses are short circuited through a diode $D_5$. With an increase in the speed of the motor, the number of pulses per unit time increases in a corresponding manner, as does the mean charging current of capacitor $C_{10}$. The mean voltage of capacitor $C_{10}$ rises, and, over and above a certain value, makes transistor $T_3$ conducting. As a result, a resistor $R_9$ forms a voltage divider with the resistor $R_8$ so that the capacitor $C_8$ after its first discharge can no more be charged to a voltage lower than the voltage drop in resistor $R_8$. The potential at point E can consequently no more reach the threshold voltage of transistor UJT as long as the contact breaker was not closed again. Hence the oscillator 15 can only supply one single discharge per ignition time as the speed of the engine reaches a predetermined value.

The device also comprises means for preventing functioning of the oscillator 15 when the engine is at stop and the user switches the ignition on. This means comprises the two RC elements formed by resistor and capacitor $R_1$ $C_1$, respectively $R_2$ $C_2$. The time constant of $R_1$ $C_1$, for example approximatively 4 ms, is shorter than the time constant of $R_2$ $C_2$ which can be approximatively 7 ms. Thus, when the supply voltage is applied to the device, the emitter voltage of transistor $T_1$ rises faster than the voltage at point B and, consequently, than the voltage at point C. Therefore the transistor $T_1$ cannot become conductive at the time of supplying the supply voltage to the device. Moreover it cannot conduct until the contact-breaker passes a first time from its closed position to its opened position.

Different modifications of the described device may be provided. Though it is usual to control the ignition spark in engines at the moment of opening the contacts of the contact-breaker, it is obvious that the device of the described type could be modified so that control of the instant of ignition takes place at the moment of closing the contacts of the contact-breaker.

It is also clear that the delay means can be provided in various manners. In principle, the delay means must be arranged to be operative for at least one of the two positions of the contact-breaker contacts as long as the contact-breaker has not undergone a change of state. To the contrary, as soon as the engine runs and the contact-breaker passes alternately from the conducting state to the non-conducting state, the delay means must be ineffective so that normal ignition of the engine will take place. One could, for example, provide a delay means which would be made ineffective by the voltage taken at the terminals of capacitor $C_{10}$ or by a similar device, this voltage being chosen with a very low value so that the delay means will be ineffective as soon as the engine runs even slowly when it is actuated by the starter.

The device according to the invention applies to ignition arrangements including any of various types of tripping devices other than the described mechanical circuit-breaker, for example a magnetic, photo-electric or capacitative tripping device.

I claim:

1. An electronic ignition device for an internal combustion engine, comprising a tripping device for controlling ignition, an ignition coil, a capacitor ($C_t$) connected to a charging circuit, an electronic switch (I) controlling discharing of said capacitor ($C_t$) into the primary winding of the ignition coil, said electronic switch being controlled from the tripping device by a control circuit (13, 14, 15) having means (15) for successively opening and closing said switch several times in each control position of said tripping device, and time delay circuit means ($R_1$, $C_1$, $R_2$, $C_2$) for preventing operation of the control circuit when the device is switched on while the tripping device is in a given position, said preventing means being ineffective when the tripping device has moved from said given position, said tripping device comprising a contact-breaker, said time delay circuit means comprising a resitor ($R_5$) connected in a circuit in series between a point (A) under the voltage of the device and a mobile contact of the contact-breaker, and means (13) sensitive to the voltage of the mobile contact of the contact-breaker or to the current passing through said resistor, said time delay circuit means further comprising a bistable trigger (13) controlled from the voltage of the mobile contact of the contact-breaker, and a delay device ($R_1$, $C_1$, $R_2$, $C_2$) for controlling voltage to the contact-breaker and trigger, said trigger being arranged to remain in a given state corresponding to non-operation of the ignition while the voltage of the mobile contact is increasing slower than the supply voltage of said trigger, said supply voltage being obtained from the voltage of a capacitor ($C_1$) forming part of a first RC element ($R_1$, $C_1$), the voltage applied to the mobile contact of the contact-breaker being derived from the voltage of said capacitor ($C_1$) and delivered to said contact by a second RC element ($R_2$, $C_2$) whose time constant is greater than that of the first RC element.

2. A device according to claim 1, comprising an integrator (14) providing a signal depending on the speed of rotation of the engine, said signal acting on said means (15) for successively closing and opening said switch (I) several times in a manner to allow only one spark for ignition as soon as the engine reaches a given speed of rotation.

* * * * *